United States Patent [19]

Vinum et al.

[11] Patent Number: 4,580,376

[45] Date of Patent: Apr. 8, 1986

[54] COLLAPSIBLE LATTICE

[75] Inventors: Michael L. Vinum; William J. Shearer, both of Arcata, Calif.

[73] Assignee: P.V.M. Redwood Company, Inc., Arcata, Calif.

[21] Appl. No.: 648,593

[22] Filed: Sep. 10, 1984

[51] Int. Cl.[4] ..... E04H 12/18

[52] U.S. Cl. ..... 52/109; 52/645

[58] Field of Search ..... 52/109, 645, 664, 665

[56] References Cited

U.S. PATENT DOCUMENTS

| | | | |
|---|---|---|---|
| 250,205 | 11/1881 | Collins | 52/109 X |
| 2,283,050 | 5/1942 | Fisher | 52/109 X |
| 2,431,933 | 12/1947 | Hartmann | 52/645 |
| 3,557,500 | 1/1971 | Schmidt et al. | 52/109 X |

FOREIGN PATENT DOCUMENTS

| | | | |
|---|---|---|---|
| 722182 | 3/1932 | France | 52/665 |

*Primary Examiner*—Alfred C. Perham
*Assistant Examiner*—Jean M. LaKemper
*Attorney, Agent, or Firm*—Ernest M. Anderson

[57] ABSTRACT

A collapsible-expandable lattice structure is described comprising a plurality of slats arranged in two panels. Each panel consists of first and second sets of parallel slats, the first set being arranged over and intersecting relative to the second set. Means is provided pivotally connecting slats of the first set to slats of the second set to form parallelogram linkages, the slats of one panel being located intermediate slats of the other panel, the first and second sets of one panel being parallel relative to the first and second sets of the other panel, respectively. Means is further provided for pivotally interconnecting slats of one panel to slats of the other to maintain a fixed pivotal relationship between slats of both panels.

2 Claims, 1 Drawing Figure

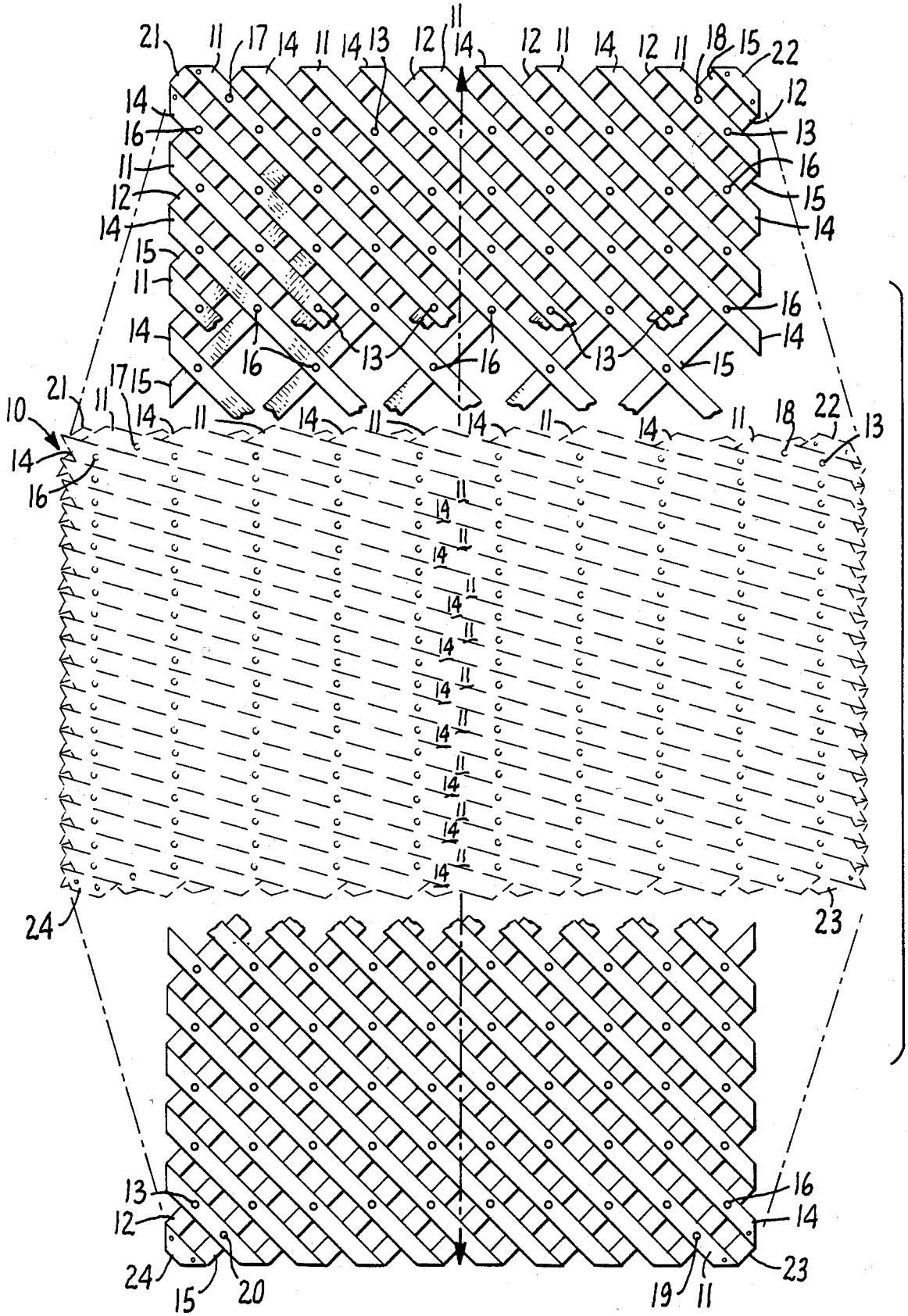
21
11
17
14
11
14
13
12
11
14
12
11
14
12
11
18
15
22
12
13
16
15
14
14
16
11
12
14
15
11
14
16
13
16
13
15
16
14
17
15
21
11
14
11
14
11
14
11
14
11
18
22
13
10
14
16
11
14
11
14
11
14
11
14
11
14
11
14
11
14
11
14
11
14
11
14
11
14
24
23
13
12
24
15
20
19
11
16
14
23

COLLAPSIBLE LATTICE

This invention relates to a construction of lattices comprising an arrangement of parallel and intersecting slats. Structures of this kind have a wide range of uses and applications. More particularly, they have been used in the construction of folding gates, structural framework and as decorative panels both for exterior and interior applications. The present invention provides a unique collapsible-expandable lattice structure that has distinct advantages for purposes of storage and transportation in a collapsed or accordian folded condition.

BRIEF DESCRIPTION OF THE DRAWING

The FIGURE is a front view of the lattice structure of the present invention illustrating both its expanded and collapsed positions.

Referring to the drawings, a preferred embodiment of the invention is illustrated in a lattice structure 10 comprising a plurality of slats arranged in two distinct panels. One panel consists of a first set of parallel slats 11 pivotally interconnected to intersecting slats 12 by rivets or other such pivotal connecting means 13. A second panel is formed by a set of parallel slats 14 pivotally connected to intersecting parallel slats 15 by pivotal connecting means 16. Slats 11 of one frame are located intermediate slats 14 of the other frame, and slats 12 of the one frame are located intermediate slats 15 of the other frame. It will be evident that pivotal connecting means as provided by rivets 13 and 16 form parallel linkages between the first and second sets of slats, allowing the interwoven lattice of slats to be accordian folded or expanded.

The two frames of intersecting and pivotally connected slats are pivotally connected at each corner by rivets 17, 18, 19 and 20. These pivots provide rigidity of one frame within the other and prevent the parallel slats of one frame from rotating relative to parallel slats of the other frame. At least two pivots are required to perform the necessary function of maintaining the parallel relationship between slats of each frame. The use of a pivot at each corner provides the greatest rigidity and strength to the lattice structure.

It will be noted that each of the slats 11 and 14 are pivotally connected to at least two slats 12 and 15 and separated by a parallel and intermediate slat of the other panel. Thus, slats 11 of one panel are separated by slats 14 of the second panel and slats 12 of the first panel are separated by parallel slats 15 of the second panel. In addition, the slats of both panels are substantially equal in width and pivotally connected at regular intervals of equal spacing along their lengths; and slats 11 are substantially coplanar to slats 14 while slats 12 are coplanar with slats 15.

With the arrangement and spacing of slats shown, lattice 10 can be pivotally collapsed or expanded while maintaining a rectangular shape. This is of importance for packaging purposes as well as transporting and storage of the lattice structures.

Once expanded the lattice structure is secured in the expanded condition by four corner rails 21, 22, 23 and 24. Each rail is secured by nails to an adjacent pair of parallel rails at each corner. In that respect, rails 21 and 23 interconnect a pair of parallel and adjacent rails 11 and 14 at one set of diagonal corners and rails 22 and 24 interconnect a pair of parallel adjacent rails 12 and 15 at the opposite pair of diagonal corners. In the pivotally collapsed condition, as shown in the center of the drawing the rails or slats 21, 22, 23 and 24 are secured to only one slat and are connected to a second parallel slat only after the lattice has been expanded.

Although a preferred embodiment of this invention has been illustrated and described, various modifications and changes may be resorted to without departing from the spirit of the invention or the scope of the appended claims, and each of such modifications and changes is contemplated.

What is claimed is:

1. In a collapsible-expandable lattice structure that comprises a plurality of slats arranged in two panels, each panel comprising first and second sets of parallel slats, said first set being arranged over and intersecting relative to said second set, and including means pivotally connecting slats of said first set to slats of said second set to form parallel linkages, the slats of one panel being located intermediate slats of the other panel, the first and second sets of one panel being parallel, respectively, relative to the first and second sets of the other panel, the improvement wherein each panel being substantially rectangular, each slat having a pair of parallel side edges and a pair of end edges that interconnect said side edges at 45°, the end edges of said first set of slats overlapping end edges of said second set of slats and being parallel thereto when said first set of slats is positioned substantially perpendicular to said second set of slats; whereby in the expanded position of the lattice structure intersecting ends of the slats become aligned to form rectilinear sides; and further including means pivotally interconnecting slats of one panel to maintain a fixed pivotal relationship between slats of both panels.

2. The lattice structure of claim 1, and means comprising four corner rails, each rails secured to an adjacent pair of parallel rails at each corner of the lattice structure when in its expanded position.

* * * * *